US008317118B2

(12) United States Patent
Davis et al.

(10) Patent No.: US 8,317,118 B2
(45) Date of Patent: Nov. 27, 2012

(54) PANEL EMPTYING BIN FOR SHREDDERS OF SHEET LIKE MATERIAL

(75) Inventors: Josh Davis, Hudson, OH (US); Xiang Xin, DangYang (CN); Li (Henry) Zhiguo, DongGuan (CN); Jeffrey Jensen, Hudson, OH (US)

(73) Assignee: Techtronic Floor Care Technology Limited, Road Town, Tortola (VG)

( * ) Notice: Subject to any disclaimer, the term of this patent is extended or adjusted under 35 U.S.C. 154(b) by 0 days.

(21) Appl. No.: 12/683,817

(22) Filed: Jan. 7, 2010

(65) Prior Publication Data

US 2010/0176230 A1 Jul. 15, 2010

Related U.S. Application Data

(60) Provisional application No. 61/143,785, filed on Jan. 10, 2009.

(51) Int. Cl.
*B02C 23/00* (2006.01)

(52) U.S. Cl. ..... 241/100; 241/285.3

(58) Field of Classification Search ..... 241/100, 241/236, 285.2, 285.3
See application file for complete search history.

(56) References Cited

U.S. PATENT DOCUMENTS 3,002,702 A * 10/1961 Peltier ..... 241/278.1
5,020,733 A * 6/1991 Strohmeyer ..... 241/100
5,035,366 A * 7/1991 Hashimoto et al. ..... 241/36
5,354,001 A * 10/1994 Hasegawa ..... 241/34
5,429,313 A * 7/1995 Schwelling ..... 241/36
5,833,151 A * 11/1998 Doak ..... 241/37.5
5,887,807 A * 3/1999 Beinecke ..... 241/36
5,919,026 A 7/1999 Appleton
7,469,849 B1 * 12/2008 Lo ..... 241/100
7,472,856 B2 * 1/2009 Shears ..... 241/285.2
7,516,880 B1 * 4/2009 Crain et al. ..... 232/45
7,537,176 B2 * 5/2009 Shen ..... 241/37.5
7,584,920 B2 * 9/2009 Huang ..... 241/285.2
7,673,825 B2 * 3/2010 Jeansonne et al. ..... 241/100
2008/0041986 A1 * 2/2008 Ko ..... 241/100
2008/0217447 A1 * 9/2008 Jeansonne et al. ..... 241/100
2009/0212145 A1 * 8/2009 Huang et al. ..... 241/285.2
2011/0056952 A1 * 3/2011 Borowski et al. ..... 220/495.06

OTHER PUBLICATIONS

European Search Report; EP App. No. 10000173.4-2316; dated Jul. 7, 2010; Munich, Germany.

* cited by examiner

*Primary Examiner* — Faye Francis
(74) *Attorney, Agent, or Firm* — Hahn Loeser & Parks LLP

(57) ABSTRACT

A chad containment bin includes a chad containment space formed by a pair of opposing longitudinally extending sidewalls connected by a pair of opposing, laterally extending sidewalls. A shredder head assembly is situated above the chad containment bin. A cabinet body supports the shredder head assembly while removeably housing the chad containment bin. A generally vertically oriented support member extends upwardly from a first of the longitudinally extending sidewalls. The support member includes a handle on an outer face for carrying the chad containment bin. A panel is pivotally connected to the chad containment bin for providing access to the chad containment space when the chad containment bin is suspended by the handle over a waste receptacle.

14 Claims, 5 Drawing Sheets

FIRST OPERATIONAL MOVEMENT

SECOND OPERATIONAL MOVEMENT

PANEL EMPTYING BIN FOR SHREDDERS OF SHEET LIKE MATERIAL

This application claims the benefit of priority to U.S. Provisional Patent Application No. 61/143,785, filed Jan. 10, 2009, entitled "PANEL EMPTYING BIN FOR SHREDDERS OF SHEET LIKE MATERIAL", by Josh Davis et al., the disclosure of which is hereby incorporated by reference in its entirety.

BACKGROUND

The present disclosure is directed toward a bin feature for a shredder device and, more specifically, to a bin having a closure member included with the bin that opens in response to a mechanical release for emptying of chad contained in the bin.

Shredder devices reduce risks of misappropriation of personal and confidential information by shredding media containing such content into strips or smaller fragments of chad. Generally, this chad is temporarily contained in a bin situated below cutter elements (of a shredder head) included in the shredder device. The chad is subsequently emptied from the bin to a trash receptacle for permanent disposal.

The process of emptying the bin for shredder appliances in households and offices generally involves a two-handed approach. The technique first includes an action of a user manually separating the bin from the shredder head suspended over, mounted to, or attached above it. In this manner, the chad contained therein can be emptied from an open end revealed from the detachment. The next action generally includes a manual flip of the bin over the trash receptacle. The bin is overturned approximately 180-degrees so that the chad can fall from the bin into the trash basket. One disadvantage associated with this technique is that the chad can fall beyond the sidewalls of the trash basket and spill onto the surrounding floor surfaces. The fragments that fall beyond the basket require additional actions of cleanup. More specifically, the tiny size and the multitude of spilled fragments make it too timely for the user to pick up each individual fragment. It is a similarly timely task to remove from and return to storage a vacuum sweeper.

There is needed a more expedient method for emptying chad contained within a shredder bin and, additionally, a method that minimizes undesired spill of chad missing the trash basket. There is more specifically desired a method that utilizes a one-handed manual approach, which does not require any over-turn of the bin.

BRIEF DESCRIPTION

A first contemplated embodiment of the present disclosure is directed toward a chad containment bin including a chad containment space formed by a pair of opposing longitudinally extending sidewalls connected by a pair of opposing, laterally extending sidewalls. A shredder head assembly is situated above the chad containment bin. A cabinet body supports the shredder head assembly while removeably housing the chad containment bin. A generally vertically oriented support member extends upwardly from a first of the longitudinally extending sidewalls. The support member includes a handle on an outer face for carrying the chad containment bin. A panel is pivotally connected to the chad containment bin for providing access to the chad containment space when the chad containment bin is suspended by the handle over a waste receptacle.

A second contemplated embodiment of the present disclosure is directed toward a bin for a shredder. The bin includes at least one generally vertically extending sidewall enclosing a chad containment space. A handle member connects to an exterior surface of the sidewall. The handle member extends in a generally vertical orientation along the sidewall. A moveable bottom panel is capable of closing a distal opening of the containment space formed by the at least one sidewall. A hinge connects an edge portion of the bottom panel with an edge portion of the sidewall. A fastener assembly holds the bottom panel in a first position to close the distal opening formed by the sidewall, which provides an access to the containment space. The fastener assembly is housed in the handle member.

A third contemplated embodiment of the present disclosure is directed toward a shredder including a header assembly containing a cutter assembly and a motor drive assembly. The shredder further includes a chad containment space formed from at least one sidewall. A support member is generally situated next to an outer surface of the at least one sidewall. A bottom panel is formed between edges of the at least one sidewall. The bottom panel and the at least one sidewall form a bin. The bottom panel is moveable from a first position for closing the chad containment space of the bin to a second position for opening an access to the chad containment space of the bin.

DETAILED DESCRIPTION

The present disclosure is directed toward a bin feature for use with a media shredder device. More generally, the bin feature is contemplated for use with shredder appliances that are for personal, office, or departmental use, although features of the present disclosure can be incorporated into shredders contemplated for industrial use as well. Furthermore, the bin of the shredder device disclosed herein is described for a collection of chad formed from shredded media, such as, for example, papers, credit cards, CDs, and other documents containing sensitive information; however, the bin, and features of the bin release, are contemplated for use in other destruction type-appliances, which include collection receptacles that temporarily collect and contain subsequently discarded article fragments.

Figure 1:
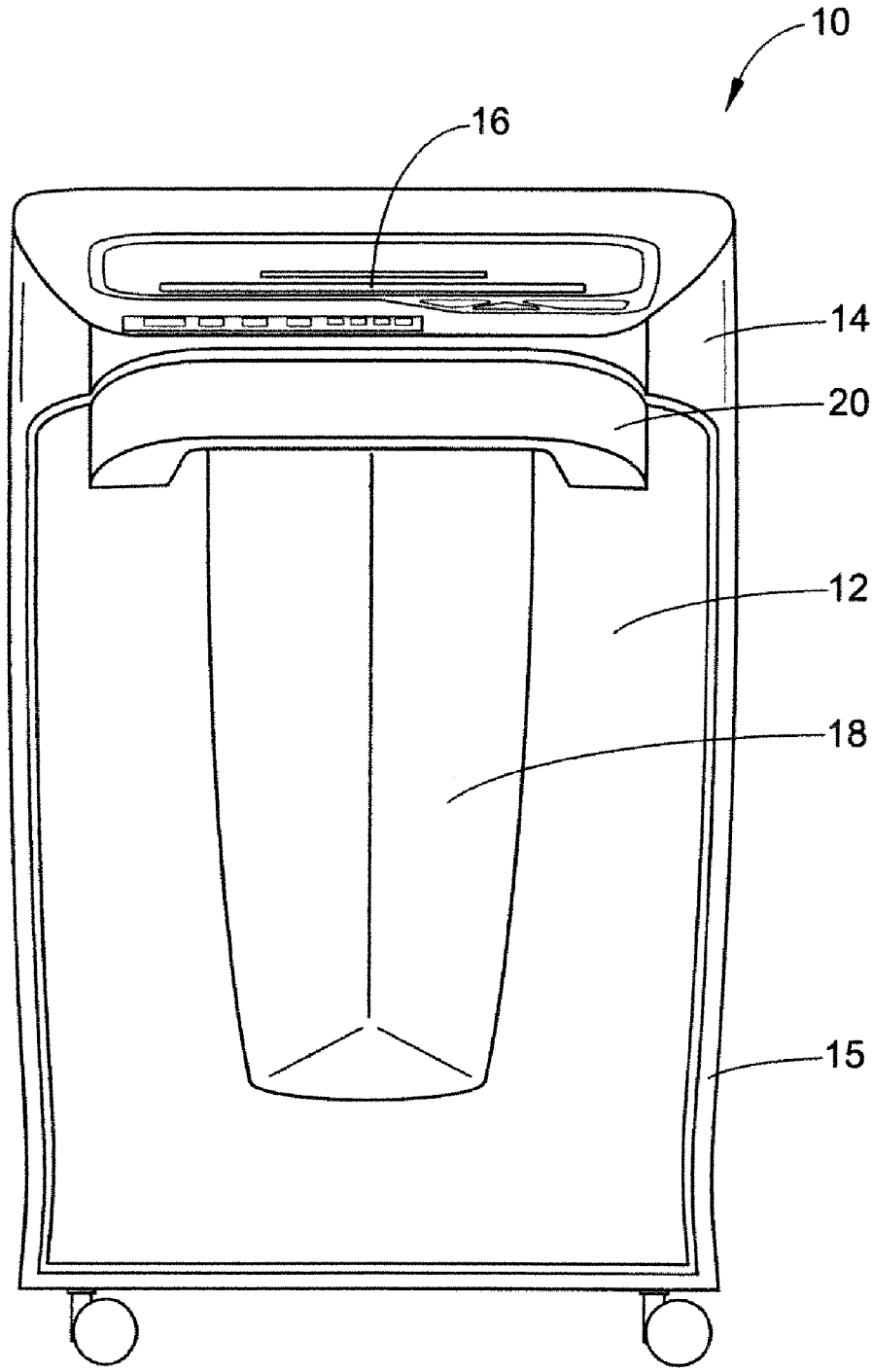
FIG. 1 illustrates a side view of a first embodiment of a bin assembly for a shredder device.

FIG. 1 illustrates a frontal side view of a shredder device 10 according to a first embodiment of the present disclosure. The shredder 10 includes a bin receptacle 12 having a containment space for temporarily housing chad. The bin receptacle 12 is situated adjacent to a head assembly 14. In the illustrated embodiment, the bin receptacle 12 is situated underneath the head assembly 14, which contains all of the mechanical and electrical systems (not shown) of the shredder device 10, such as, for example, a motor drive and cutter assembly. More specifically, media is inserted into a feed slot 16 situated on the head assembly 14 for providing access to the mechanical shredder systems. The feed slot 16 directs the media to the mechanical shredding system, and then the chad formed therefrom empties into the bin receptacle 12. In the disclosed embodiment, a transparent region (hereinafter referred to as "window 18") is optionally situated on at least one sidewall portion defining the bin 12. This window is one means of visually determining when the bin receptacle 12 is full. Other indication means can include automation, a visual display, or an audible indicator that activates by means of a detector. When the bin receptacle 12 is full of chad, the contents must be emptied into a separate trash receptacle. The present disclosure is directed toward a feature for emptying the bin receptacle 12 of the chad.

In the illustrated embodiment of FIG. 1, the bin receptacle 12 separates from the head assembly 14 when the bin 12 is to be emptied. A handle 20 is situated on an outer surface of the bin receptacle 12 for assisting in separating the 12 bin from the head assembly 14. This handle 20 is illustrated as protruding outwardly from a front face of the shredder device 10 and, more specifically, from a front face of the bin 12. Force pulling on the handle 20 removes the bin receptacle 12 away from the head assembly 14. It is anticipated that when the bin receptacle is removed, the head assembly 14 may remain suspended at the same height and position by means of a support body or structure. This support body may be, for example, a cabinet 15 including a bottom wall and/or at least one non-continuous wall extending upwardly therefrom. The cabinet 15 can include a number of sidewalls equal to and generally corresponding in dimension to the walls defining a containment space of the bin receptacle 12. The cabinet includes an opening, which provides removeable access for the bin 12. The head assembly 14 is fixedly supported to a top of the cabinet 15.

Other support structures are contemplated to include, for example, posts, and a pair of generally planar opposing walls, etc. In this manner, the bin receptacle is removably housed in a shredder device structure 10. In one embodiment, the bin receptacle 12 may not separate from the head assembly 14 when the chad contained therein is emptied to a waste receptacle. Rather, the head assembly 14 mounts to an (upper) adjacent portion of the bin receptacle 12. In these anticipated more compact and lighter construction embodiments, the entire shredder unit 10 is carried over to and maintained above the waste receptacle for emptying. In this manner, the handle 20 on the front face of the bin 12 is used to support the entire shredder device 10 as it is moved from a first location to a second location.

Figure 3:
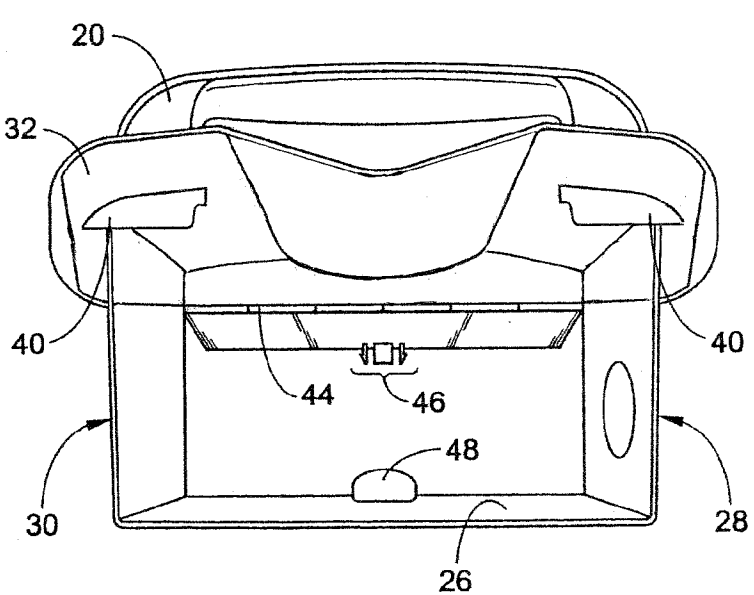
FIG. 3 illustrates a top view of the bin assembly of FIG. 1 in a second operative position.
Figure 2:
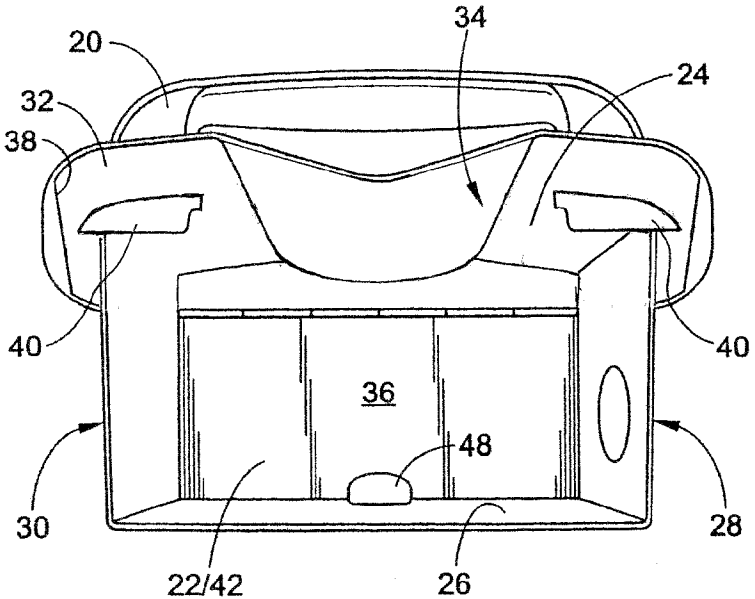
FIG. 2 illustrates a top view of the bin assembly of FIG. 1 in a first operative position.

FIGS. 2 and 3 illustrate a top view of the bin receptacle 12 removed from the supporting cabinet body 15 of the shredder device 10 or, alternatively, separated from the head assembly 14. The bin receptacle 12 includes a bottom wall 22 for supporting a pile of chad built thereon as it falls or fell from the header assembly 14. At least one continuous wall extends upwardly from a perimeter of the bottom wall 22. The illustrated figures show a pair of oppositely extending longitudinal walls 24, 26 connected by a pair of oppositely extending lateral walls 28, 30. There is no limit made herein to a number and to a length of connected walls. In the present embodiment, for example, the lateral walls can be equal or unequal to the longitudinal walls in length.

In the illustrated embodiment, a first in the pair of longitudinal walls 24 includes a height that extends beyond a top perimeter of a second (opposing wall) 26 in the pair of longitudinal walls. This first longitudinal wall 24 is associated with a generally vertically oriented support wall 32. In one embodiment, the support wall 32 is the first longitudinal wall 24, wherein the first longitudinal wall 24 is taller than the second longitudinal wall 26. In another embodiment, the support wall 32 is separate from the first longitudinal wall 24. In one embodiment, the support wall 32 (hereinafter synonymously referred to as "support member") can extend upwardly from a top edge portion of the first longitudinal wall 24. In another embodiment, the support wall 32 can be integral to or formed from a surface portion of the first longitudinal wall 24. In this manner, an inner face of the support member 32 can be situated adjacent to an outer face of the first longitudinal wall 24. In the contemplated embodiments, a plane of which a top perimeter of the support member 32 is situated is beyond and/or above a plane of which the top perimeter of the second longitudinal wall 26 is situated.

The handle 20 is shown as being integrally connected to an outer face 34 of the support member 32. The handle 20 is furthermore illustrated as being connected to the support member 32 at a height that is beyond a top perimeter of the walls 24-30 forming the containment space portion 36 of the bin receptacle 12. The handle 20 is illustrated in the present embodiment as being generally horizontal in orientation, i.e., parallel to the floor or external shredder device support surface. The support member 32 furthermore extends beyond a length of the first longitudinal wall 24 and wraps around a corner 38 formed between the terminal ends of the first longitudinal wall 24 and corresponding terminal ends of the first and second lateral wall 28, 30. In this manner, the support member 32 extends adjacent to a limited length of the lateral walls 28, 30.

The support member 32 further includes inwardly projecting flanges 40 situated coincident to a plane extending across the bin receptacle 12 and, more specifically, coincident with a top perimeter of the containment space 36 formed between the walls 24-30. These flanges can fit or be received into arrangement under a corresponding surface of the head assembly 14 when the bin receptacle 12 is inserted into either the cabinet 15 or another head support body structure of the shredder device 10. These flanges 40 can alternatively support the head assembly 14 for embodiments of which the head assembly 14 mounts to the support member 32, and the entire shredder device 10 is thus carried to the waste receptacle.

One aspect of the present disclosure is a bottom panel 42 that is moveable from a first closed position (FIG. 2) to a second open position (FIG. 3). In one (shown) embodiment of the disclosure, the bottom panel 42 is formed from the entire bottom wall 22. In another embodiment of the disclosure, the bottom wall 42 includes the bottom panel 42 within a region of its surface. The first position of the bottom panel 42 is illustrated in FIG. 2 to essentially close the containment space 36 of the bin receptacle 12 so that a chad pile can be built therein and supported thereon. An outer perimeter of the bottom panel 42 is situated adjacent to an outer lower edges of the longitudinal and lateral side walls 24-30 in the embodiment of which the bottom wall 22 is the bottom panel 42 or adjacent to a perimeter of an opening in the embodiment of which the bottom panel 42 is formed through the bottom wall 22. The second position of the bottom panel 42 is illustrated in FIG. 3 to essentially provide an access to the containment space 36 of the bin receptacle 12 so that the chad pile can be emptied therefrom. The second position is associated with an open bin receptacle 12.

The bottom panel 42 of the present embodiment is illustrated as one generally planar access that is connected to at least a lower edge portion of one of the longitudinal walls 24, 26. There is no limitation made herein to which edge portion associated with any one wall 24-30 of the bin receptacle 12 that the bottom panel 42 is connected to. In other embodiments, the bottom panel 42 can include at least a perimeter portion connected to at least a lower edge portion of a lateral wall 28, 30. The bottom panel 42 can include a perimeter portion connected to a corresponding longitudinal extent (i.e., length) of an edge of a sidewalls 24-30. In other embodiments, the bottom panel 42 can include at least a perimeter portion connected to a corresponding perimeter portion forming a window (not shown), an opening, or a similar access provided in the bottom wall 22.

It is anticipated that in another alternate embodiment (not shown), an access in the form of a panel can be included one of the longitudinal or lateral walls 24-30 defining the containment space 36. It is contemplated that a side panel can be pivotally connected to the bin receptacle body along at least a lower perimeter portion situated in proximity to the lower edge of the sidewall 24-30. In this manner, the sidewall panel can pivot outwardly away from the containment space 36, wherein it more specifically falls downwardly. The pivotal connection made between the (bottom or side) panel and the bin receptacle 12 is not limited to any one corresponding panel perimeter and/or opening or wall edge pair.

Furthermore, other embodiments are contemplated of which the panel moves from the first (closed) to the second (open) position. One example includes a panel that is slidenly connected to the bin receptacle 10 at opposite edges. The panel can slide along parallel and oppositely extending tracks formed in the corresponding (bottom or side-) wall 22-30 of the bin receptacle 10. In this manner, a dimensioned perimeter portion of the panel is received in and moves along the track length. Similarly, the access panel can move from the first to the second position by means of a series of folds or bends that compress like accordion pleats. There is no limitation made herein to a manner of which a moveable panel is repositioned from a first home position to a second operative position.

In a further contemplated embodiment, access can be provided to the containment space 36 for emptying the bin receptacle 12 by means two adjacent bottom panels (not shown) that open outwardly away from one another. Their corresponding edges meet when the bin receptacle 12 is in a first position, but the panels open away from one another in the second position. In this embodiment (not shown), the opposite (farthest) corresponding edges of each panel are respectively connected to respective lower edge portions of the opposite and/or parallel sidewalls 24-30 or opposite perimeter portions of an opening through the bottom wall 22.

The bottom panel 42, as shown in FIG. 2, is generally transverse to the first longitudinal wall 24 in the first closed position. As the bottom panel 42 moves toward the second, open position, it pivots outwardly such that it is generally coincident at one position to a plane of which the first longitudinal wall 24 extends. The bottom panel 42 may rotate beyond this plane. The bottom panel 42 is generally pivotal outwardly at its connection edge 44, which is generally coincident with a lower edge of the first longitudinal wall 24 in the illustrated embodiment; however, the connecting edge 44 can rather be coincident with the lower edge of the second longitudinal wall 26 or one of the lateral walls 28, 30 such that it pivots outwardly to be generally coincident at one position with a plane of which that corresponding wall 26-30 is associated.

In one embodiment, the bottom panel 42 can move from the first position toward the second position by means of gravity. More specifically, the bottom panel 42 can fall downwardly away from the containment space 36 when it is moving toward the second position. In one embodiment, the pivotal connection 44 between the bottom panel 42 and the bin receptacle 12 includes a hinge. In another embodiment, the pivotal connection 44 made between the bottom panel 42 and the bin receptacle 12 includes a tension coil spring. In this embodiment, the tension coil spring causes the bottom panel 42 to be biased toward the second position and away from the containment space 36. It is anticipated that the bottom panel 42 is returned from the second position to the first position by means of an operator urging it upwardly to close the containment space 36 of the bin receptacle 12.

The present disclosure includes features to maintain the bottom panel 42 in the first, closed position. One feature includes a pair of fastening members (hereinafter synonymously referred to as a "fastening assembly"). In one embodiment, a first fastening member 46, such as, for example, a catch, situated on one of the bottom panel 42 or the bin receptacle 12 can be grasped by a second fastening member 48, such as, for example, a lock situated on the other of the bottom panel 42 or the bin receptacle 12. In the illustrated embodiment of FIGS. 2-5, the first fastening member 46 is situated in proximity to a perimeter portion of the bottom panel 42. More specifically, the first fastening member 46 is situated on a perimeter portion opposite the connection edge 44. This first fastening member 46 works in conjunction with the second fastening member 48, which is situated on the bin receptacle 12 body and adjacent thereto the first fastening member 46 when the bottom panel 42 is in the closed position to maintain the bottom panel 42 closed against a force of gravity in a hinged connection or a bias in the tension coil spring connection.

In one embodiment, the first fastening member 46 can be either a first of a catch or a lock and the second fastening member 48 can be a second of the catch or the lock, wherein the catch grasps the lock to maintain the bottom panel closed. In one embodiment, the first fastening member 46 can be either a first of a snap fastener or a socket and the second fastening member 48 can be a second of the snap fastener or socket, wherein the snap fastener is received in the socket to maintain the bottom panel closed. There is no limitation made herein to the type of device that mechanically engages the panel 42 to the bin receptacle 12; rather, any known mechanical assembly can be utilized including, for example, a male component received by a female component and maintained therein by an interference fit arrangement, a claw or a hook bar-type component received by an eye-type component and maintained therein by a grasp, and a later described locking rod assembly pressing against a protrusion.

Figure 4:
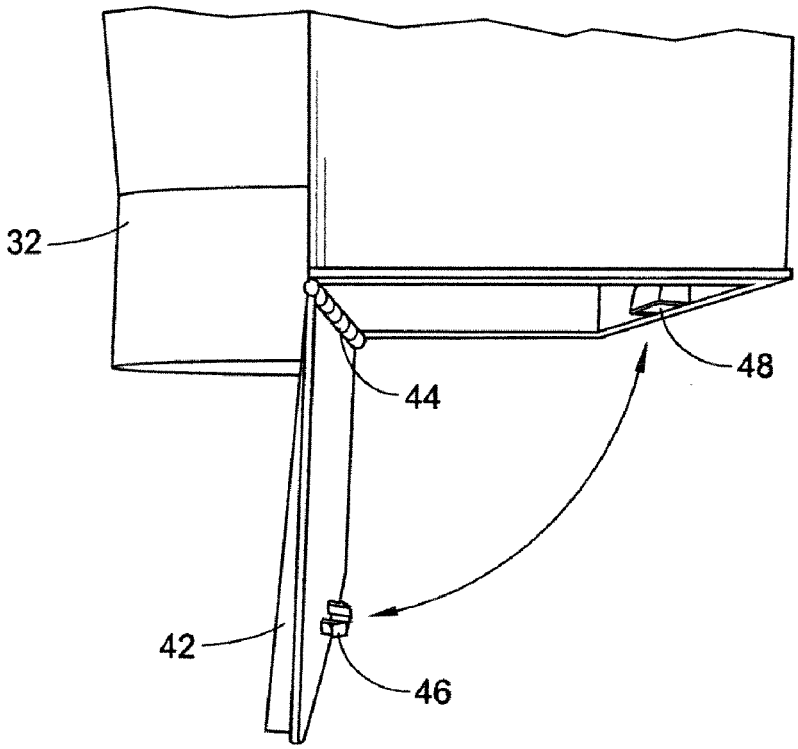
FIG. 4 illustrates a side perspective view of the bin assembly in the second operative position of FIG. 3.
Figure 5:
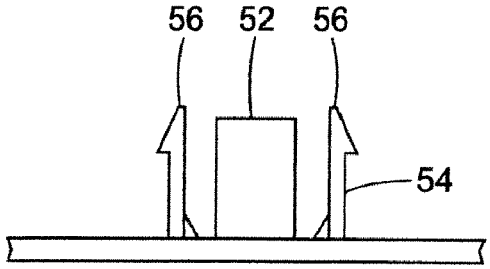
FIG. 5 illustrates the mechanical fastener feature shown in FIG. 4.

In the illustrated embodiment, the first fastening member 46 is situated in proximity to the unconnected (second) edge of the bottom panel 42. FIGS. 4 and 5 illustrate this first fastening member 46 to include a locking protrusion 52 that extends upwardly from a proximity of the unconnected edge of the bottom panel 42. The locking protrusion 52 extends generally perpendicular to an inner face 50 of the bottom panel 42. The locking protrusion 56 is received in the second fastening member 48, which can be, for example, an enclosed catch, locking rod, or snap-fastener socket. The first fastening member 46 is more specifically illustrated as including a pair of tongues 54 extending upwardly and parallel to the locking protrusion 52. The tongues 54 each include a catch flange 56 at the distal point having a diameter and/or circumference greater than the innermost length portion of the tongue 54.

The catch flanges 56 catch on the corresponding second fastening member 48 when the first fastening member 46 is received by the second fastening member 48.

The second fastening member 48 is illustrated as being situated on an inner face 58 of the second longitudinal wall 26. More specifically, this second fastening member 48 is situated in proximity to a bottom or sidewall edge that meets the perimeter of the bottom panel 42 in the closed position. The second fastening member 48 is shown as being more specifically situated at the lower edge of the second longitudinal wall 26.

FIGS. 2 and 3 illustrate a pocket 60, which houses the second fastening member 48. The pocket 60 protrudes outwardly from the inner face 58 of the second longitudinal wall 26. An interior of the pocket 60 includes the corresponding engagement for the first fastening member 46. More specifically, the pocket 60 can be an enclosed socket. In this embodiment, the first fastening member 46 is a snap-fastener that snaps into an engagement with the socket. The pocket 60 can alternatively enclose a catch or a corresponding engagement mechanism. As previously articulated, the corresponding engagement mechanism grasps the first fastening member 46 as it is inserted in the pocket 60.

Figure 6:
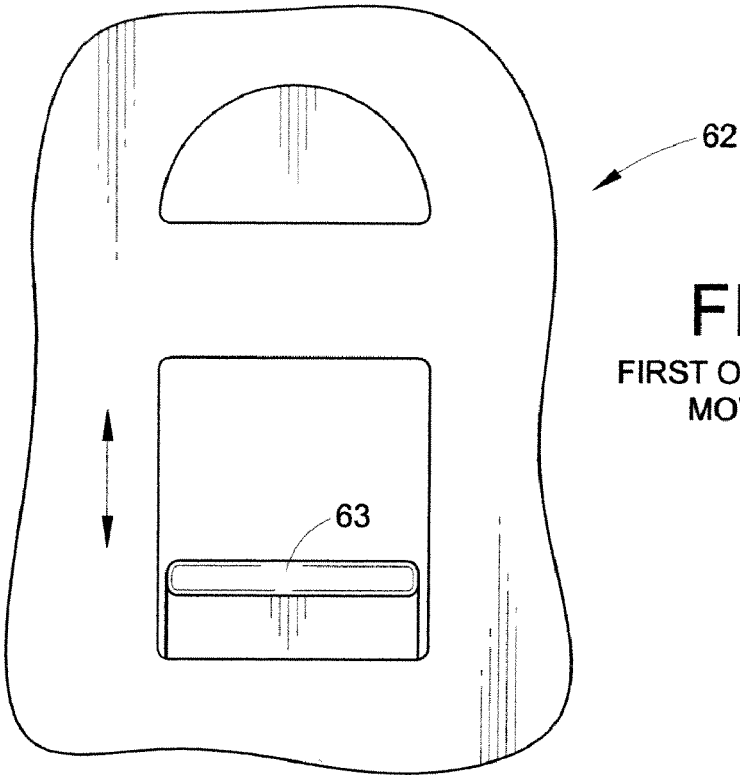
FIG. 6 illustrates a release mechanism for use with the bin assembly and associated with the first operative position of FIG. 2.
Figure 7:
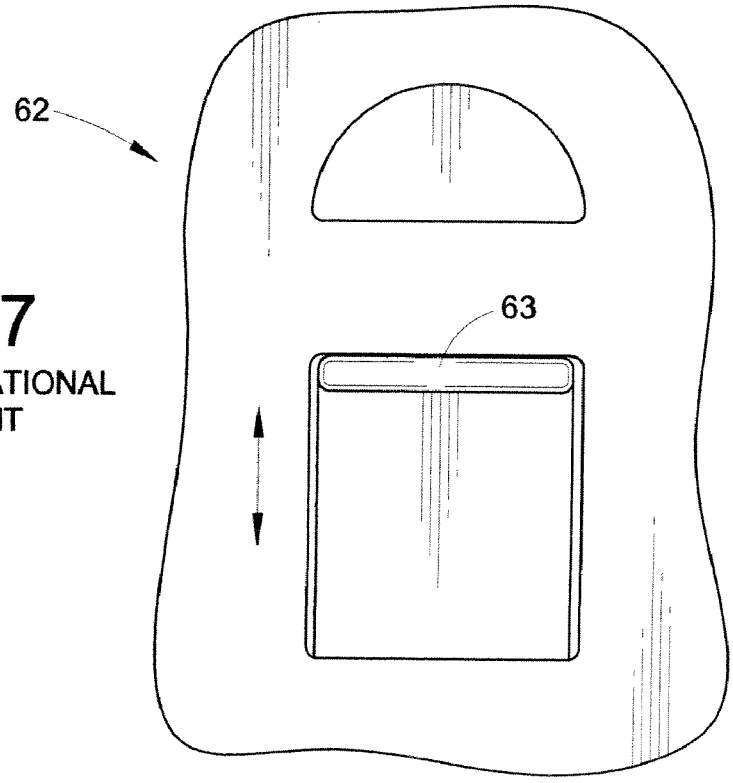
FIG. 7 illustrates the release mechanism of FIG. 6 associated with the second operative position of FIG. 3; and, FIG. 8 illustrates a side cross-sectional view of a second embodiment of a bin assembly for a shredder device.

It is anticipated that a method utilized to release the catch-lock or snap-fit engagement of the present disclosure is to mechanically activate disengagement between the first and second fastening members 46, 48. FIGS. 6-7 illustrates the operative positions of a user-activated and accessible release mechanism 62 operatively associated with the fastener assembly, which is associated with and maintains the open and closed bottom panel positions. More specifically, the mechanical release 62 is a user-activated mechanism that can take a form of (and not limited to) a press-button, a tactile switch, a dial switch, and a release knob. The present illustration of FIG. 6 shows a linearly slideable switch-type release mechanism associated with the first position. The first position is associated with the home (closed) position or first operative (containment) mode. A linear slideable switch 63 is biased toward the a position associated with the closed panel. A user slides the switch 63 against that bias to move the switch 63 to a second location (FIG. 7), which causes the engagement between the first and second fastening members 46, 48 to release contact thereof. This second position is associated with the open position or second operative (empty) mode. Upon the release, the (natural or spring-based) bias of the pivotal connection 44 causes the bottom panel 42 to fall away from the containment space 36.

In the illustrated embodiments of FIGS. 1-7, the release mechanism is situated on an outer face 64 of the second longitudinal wall 26 opposite the pocket 60 or socket, although the specific location should not be construed as limiting. The release mechanism can be situated at any position on the bin receptacle 10 within access to the user. The user suspends the bin receptacle 12 over a waste basket with one hand using the handle 20 (FIGS. 1-3) while releasing the bottom panel 42 of the bin receptacle 12 with the other hand using the release mechanism 62. The release mechanism 62 is easily accessible on the outer face 64 of the longitudinal sidewall 26. The release mechanism is operatively associated with and/or in communication with the fastener assembly situated directly there behind on the inner face 58 of the longitudinal wall 26.

Figure 8:
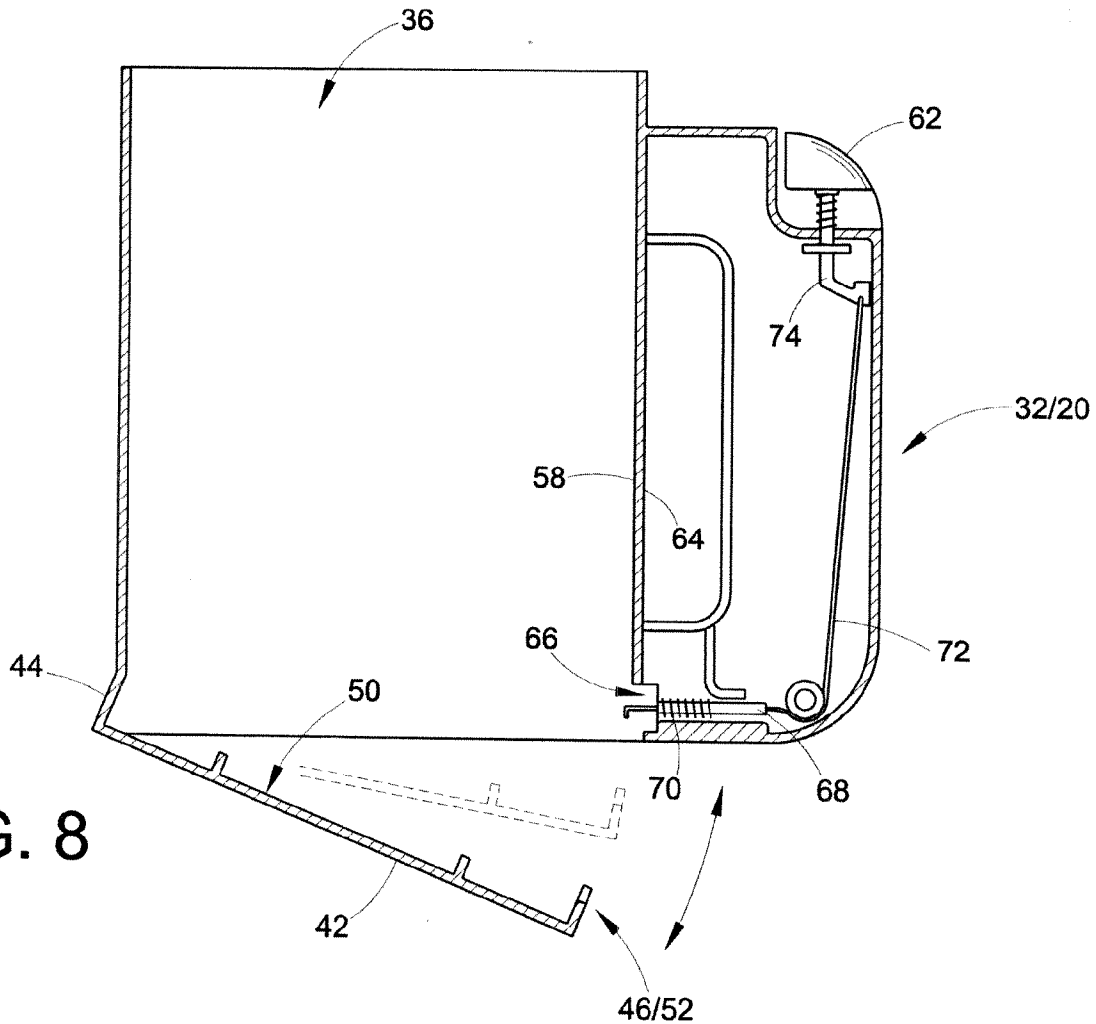

In another contemplated embodiment illustrated in FIG. 8, the mechanical release 62 can be situated near the handle 20 for carrying the shredder device 10 or the bin receptacle 12. In this manner, the user can utilize a one-handed method for emptying chad from the bin receptacle 12. It is anticipated that when the user carries the bin receptacle 12 toward the trash, the mechanical release 62 is situated within proximity of the handle 12 so that at least one finger can activate it from where the user is grasping the handle 20. In other embodiments, the release mechanism can be located on an exterior face of the bin receptacle sidewalls 12 or the support member 32 within an easy reach of the user.

FIG. 8 illustrates a cross-sectional view of a second bin receptacle 12 embodiment, which shows the mechanics of the fastener assembly for releasing the bottom panel 42 to an open position. A locking protrusion 52, similar to that previously described, extends upwardly from a second perimeter of the bottom panel 42 opposite the first edge forming the pivotal connection 44. The locking protrusion 52 is removeably received inwardly within a depth of a locking groove 66 formed in proximity to a lower edge of a sidewall 24-30. This locking groove 66 may be defined in a form of a pocket (not shown) that protrudes outwardly from an inner face of the sidewall 24-30. Alternatively, this locking groove 66 may be formed in proximity to or between a lower edge where the first longitudinal wall 24 and the adjacent support member meet 32. The locking groove 66 may be defined as a close-ended channel formed by the foregoing combination of structures. Alternatively, the locking groove 66 can be simply an opening of which the locking protrusion 52 can travel through.

A corresponding locking rod 68 is housed in between a generally continuous or closed inner surface of the support member 32. This locking rod 68 may be biased toward the locking groove 66. More specifically, the locking rod 68 includes a spring member 70 disposed around its outer cylindrical or similarly-shaped surface. This spring member 70 urges the locking rod 68 toward the locking protrusion 52 when the locking protrusion 52 is received in the locking groove 66 or opening. The locking rod 68 pushes against the locking protrusion 52 to prevent movement of the locking protrusion 52. When the locking rod 68 is not situated in the locking groove 66 or opening, i.e., when the bottom panel 42 is in the open position, the locking rod 68 urges inward and occupies a portion of the locking groove space or the containment space 36 of the bin receptacle 12.

The release assembly of the embodiment illustrated in FIG. 8 further may include a mechanical linkage 72 connected to a terminal end of the locking rod 68. This mechanical linkage 72 can extend through a compartment formed between the support member 32 and the first longitudinal wall 24. In the illustrated embodiment of FIG. 8, the mechanical linkage is a wire linkage 72' that extends through a hollowed space formed inside the support member 32. In this embodiment, the support member is a handle 20. The handle member 20 is illustrated as being a generally vertically extending handle 20 including the mechanical release mechanism 62 at its upper, outer corner. This handle 20 is intended for a user to wrap a palm of a hand around, wherein the user's thumb is anticipated as resting in proximity to and/or on the release mechanism 62.

The second, opposite terminal end of the wire linkage 72 is connected to the release mechanism 62. The second terminal end of the wire linkage 72 is more specifically connected to the release mechanism 62 by means of a pressing member 74 contained in the support member 32 for biasing the release mechanism 62.

The handle 20 and/or support member 32 is connected to an outer face of the first longitudinal sidewall 24. It is anticipated that when a user activates the release mechanism 62 by urging at least a finger against a bias of the release mechanism 62, at least a portion of the pressing member 74 pivots upwardly to cause the wire linkage 72 to pull the locking rod 68 away from the locking groove 66.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A shredder, comprising:

a chad containment bin including a chad containment space formed by a pair of opposing longitudinally extending sidewalls connected by a pair of opposing, laterally extending sidewalls;

a handle on an outer face of the containment bin, a mechanical release situated near the handle, the chad containment bin suspendable by the handle, the mechanical release activatable by user's hand holding the handle while the chad containment bin suspended by the hand;

a shredder head assembly situated above the chad containment bin;

a cabinet body for supporting the shredder head and removeably housing the chad containment bin; and, a bottom panel pivotally connected to the chad containment bin releasable by the mechanical release for providing access to the chad containment space.

2. The shredder of claim 1, further including a bottom panel being moveable from a first closed position to a second open position, wherein the sidewalls extend upwardly from the bottom panel in the first position such that the bottom panel is generally transverse to a first of the longitudinally extending sidewalls, and wherein the bottom panel is pivotal outwardly to the second position such that the bottom panel is generally coincident to the first of the longitudinally extending sidewalls.

3. The shredder of claim 2, wherein the bottom panel is pivotal outwardly at a first perimeter portion generally coincident with a lower edge of the first longitudinally extending sidewall.

4. The shredder of claim 3, further including:

a first fastening member situated in proximity to a second perimeter portion of the bottom panel and opposite the first perimeter portion, and, a corresponding, second fastening member formed on an inner face of the second longitudinally extending sidewall;

wherein the second fastening member engages the first fastening member to maintain the bottom panel in the first closed position.

5. The shredder of claim 4, where the mechanical release is adapted to release the first fastening member from a grasp of the second fastening member for emptying the chad containment space.

6. The shredder of claim 4, wherein the first fastening member includes a snap-fastener and the second fastening member includes a socket.

7. The shredder of claim 6, wherein the first fastening member and the second fastening member are operatively associated with the mechanical release.

8. The shredder of claim 7, wherein the mechanical release includes a user activated and accessible actuator switch situated on an outer face of the second longitudinally extending sidewall opposite the socket on the inner face.

9. The shredder of claim 2, wherein the bottom panel is pivotal outwardly at a first perimeter portion generally coincident with a lower edge of the second longitudinally extending sidewall.

10. The shredder of claim 1, wherein a coil tension spring pivotally connects the panel to the chad containment bin.

11. A shredder including a header assembly containing a cutter assembly and a motor drive assembly, further comprising:

a chad containment space formed from at least one sidewall, the chad containment space suspendable by a handle on an outer face of the sidewall, a mechanical release situated near the handle, the mechanical release activatable by user's hand holding the handle while the chad containment bin suspended by the hand;

and, a bottom panel releasable by the mechanical release formed between edges of the at least one sidewall, the bottom panel and the at least one sidewall form a bin;

wherein the bottom panel is moveable from a first position for closing the chad containment space of the bin to a second position outwardly from the containment space opening an access to the chad containment space of the bin.

12. The shredder of claim 11, further including:

a lock formed on an inner surface of the bottom panel that engages a corresponding catch formed on an inner surface of the at least one sidewall; and, a hinge connecting an edge portion of the at least one sidewall with a corresponding edge portion of the bottom panel;

wherein the hinge biases the bottom panel toward the second position when the lock is not captured by the catch.

13. The shredder of claim 12, the mechanical release operatively associated with the catch, where movement of the mechanical release releases the lock from a grasp of the catch so that the bottom panel can pivot to the second position for emptying of associated chad contained within the bin.

14. The shredder of claim 11, wherein the mechanical release is a user-manipulated switch.

* * * * *